US007568368B2

(12) United States Patent
Scarlin et al.

(10) Patent No.: US 7,568,368 B2
(45) Date of Patent: Aug. 4, 2009

(54) METHOD FOR THE SURFACE TREATMENT OF FERRITIC/MARTENSITIC 9-12% CR STEEL

(75) Inventors: Richard Brendon Scarlin, Oberflachs (CH); Reinhard Knoedler, Sandhausen (DE); Stefan Straub, Mannheim (DE)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 12/134,400

(22) Filed: Jun. 6, 2008

(65) Prior Publication Data

US 2008/0307847 A1 Dec. 18, 2008

(30) Foreign Application Priority Data

Jun. 15, 2007 (DE) ..... 10 2007 028 276

(51) Int. Cl.
*C21D 7/06* (2006.01)
*F01D 5/14* (2006.01)

(52) U.S. Cl. ..... 72/53; 29/90.7; 451/38

(58) Field of Classification Search ..... 72/53; 29/90.7; 451/38

See application file for complete search history.

(56) References Cited

U.S. PATENT DOCUMENTS

| | | | | |
|---|---|---|---|---|
| 4,426,867 | A * | 1/1984 | Neal et al. | 72/53 |
| 4,428,213 | A * | 1/1984 | Neal et al. | 72/53 |
| 5,057,108 | A * | 10/1991 | Shetty et al. | 72/53 |
| 5,113,681 | A * | 5/1992 | Guesnon et al. | 72/53 |
| 5,733,392 | A * | 3/1998 | Usher | 72/53 |

FOREIGN PATENT DOCUMENTS

| | | |
|---|---|---|
| DE | 19517275 | 11/1996 |
| DE | 69225065 | 11/1998 |

OTHER PUBLICATIONS

Aguero, A., et al., "Steam Oxidation of Slurry Aluminide Coatings on Ferritic Steels for Advanced Coal-Fired Steam Power Plants," Mat. Sci. For. 2004, vols. 461-464, pp. 957-964m Trans Tech Publications, Switzerland.

Haruyama, H., et al., "Effect of shot peening and pre-oxidation treatment in air on steam oxidation resistance of Mod.9Cr-1Mo steel," EPRI 2004, National Institute for Materials Science, pp. 659-667, Japan.

Caplan, D., "Effect of Cold Work on the Oxidation of Fe—Cr Alloys in Water Vapour at 600oC," Corrosion Science 1966, vol. 6, pp. 509-515, Pergamon Press Ltd., Great Britain.

Minami, Y., et al., "Steam-Oxidation Resistance of Shot Blasted Stainless Steel Tubing After 10-Year Service," NKK Tech. Rev. 1996, vol. 75, pp. 1-10, JFE Steel Corp., Japan.

Search Report for German Patent App. No. 10 2007 028 276.3 (Oct. 5, 2007).

* cited by examiner

*Primary Examiner*—David B Jones
(74) *Attorney, Agent, or Firm*—Cermak Kenealy Vaidya & Nakajima LLP; Adam J. Cermak

(57) ABSTRACT

A method for the surface treatment of ferritic/martensitic 9-12% Cr steels for the purpose of achieving an improved oxidation behavior and increased resistance to solid particle erosion at application temperatures of above 500° C., in particular around 650° C., in steam includes, in a first step, a known shot peening of the surface of the steel with steel particles, and, subsequently, in a second step, shot peening with glass particles, optionally, in a following third step, the surface of the steel being smoothed. A subsequent additional heat treatment is unnecessary.

4 Claims, 1 Drawing Sheet

METHOD FOR THE SURFACE TREATMENT OF FERRITIC/MARTENSITIC 9-12% CR STEEL

This application is claims priority under 35 U.S.C. § 119 to German patent application number 10 2007 028 276.3, filed 15 Jun. 2007, the entirety of which is incorporated by reference herein.

BACKGROUND

1. Field of Endeavor

The invention relates to the field of material technology, and more particularly to a method for surface treatment of ferritic/martensitic 9-12% Cr steels which are used predominantly for the production of components employed in steam power stations. These steels are exposed to high temperatures (typically 600 to 650° C.) and therefore have to be protected against damage, that is to say loss of quality, as a result of oxidation and subsequent flaking.

2. Brief Description of the Related Art

It is known that austenitic steels which are highly alloyed, inter alia, with chromium, are employed for superheater and intermediate superheater tubes in power stations. It is known of austenitic steels that an improved oxidation behavior of the material can be achieved by means of a cold forming of the surface, for example by bombarding the surface of the steel with small particles of a carbon steel at high velocity (=shot peening). The reason for this is a martensitic transformation of the surface thus treated, in which a large number of grain boundaries arise, which, in turn, enable the chromium present in the steel to migrate onto the surface and there form chromium oxides which then protect the material against further oxidation (see D. Caplan, Corr. Science 6 (1966), 509 and Y. Minami, NKK Tech. Rev. 75 (1996),1).

Furthermore, ferritic/martensitic steels with approximately 9-12% Cr are known which are used predominantly for tubes, valves and housings. Mention may be made as examples of these of the steels P92 (chemical composition in % by weight: 0.12 C, 0.5 Mn, 8.9 Cr, 0.4 Mo, 1.85 W, 0.2 V and the rest iron and unavoidable impurities) and also E911 (chemical composition in % by weight: 0.11 C, 0.35 Mn, 0.2 Si, 9.1 Cr, 1.01 Mo, 1.00 W, 0.23 V, and the rest iron and unavoidable impurities). These ferritic/martensitic steels, because of their chemical composition, are generally less oxidation-resistant than austenitic steels, but they usually likewise have to withstand high temperatures of up to 620° C. in modern power stations. To protect steels of this type against harmful oxidation, therefore, special coatings were developed (A. Agüero, R. Muelas, Mat. Sci. Forum, Vol. 461 (1994), 957). These coatings have the disadvantage, on the one hand, of being costly and, on the other hand, of not always being reliable. If coatings are applied, there is always the need for heat treatment or even several heat treatments which, in turn, are costly and time-consuming, particularly because very large components have to be heat-treated in power station construction. Alternatives, above all simpler possibilities for oxidation protection for ferritic/martensitic steels of this type have therefore already been desired for a long time.

In contrast to austenitic steels, however, the known shot peening, in the case of ferritic/martensitic steels, does not have the positive effect described above because of the different structure.

Nevertheless, H. Haruyama, H. Kutsumi, S. Kuroda and F Abe, Proc. of EPRI Conf., (2004), 659-667, reported a slight increase in the oxidation resistance of steels of this type in steam when these have been shot-peened with pure chromium particles before temperature and steam loading and have subsequently been subjected to heat treatment at 700° C. The latter, however, has the disadvantage of being highly cost-intensive and is undesirable in terms of the required structure in power station construction.

SUMMARY

One of numerous aspects of the present invention includes a method for the surface treatment of ferritic/martensitic 9-12% Cr steels, by which it is possible to vary the structure of these steels such that a greatly improved oxidation behavior and increased resistance to solid particle erosion at application temperatures above 500° C., in particular of around 650° C., in steam are achieved. The method is capable of being used cost-effectively and simply and can lead to good results without an additional heat treatment of the components.

Another aspect of the present invention includes that, in the method for the surface treatment of ferritic/martensitic steels, for the purpose of increasing the oxidation resistance and the resistance to solid particle erosion, a) in a first step, a known shot peening of the surface of the steel with steel particles is performed, and, b) subsequently, in a second step, shot peening with glass particles is performed.

One advantage is that ferritic/martensitic steels surface-treated in this way are distinguished by improved oxidation resistance, as compared with untreated ferritic/martensitic steels, when they are used at high temperatures in steam surroundings, such as are typical, for example, in the case of blades of a high-temperature steam turbine.

The method is cost-effective, moreover, since, in the case of ferritic/martensitic steels, it manages without the additional heat treatment steps necessary in the prior art for known methods.

Methods embodying principles of the present invention can have a surprising effect that a process other than the strain hardening process, ineffective in ferritic/martensitic steels, plainly plays a part in the surface of the material. One possibility is that the glass particles are embedded into the surface or else a microalloying of the material on the surface takes place, thus giving rise to a protective action against oxidation.

It is particularly advantageous if the material shot-peened with steel particles in a first step and shot-peened with glass particles in a following second step is subsequently finely smoothed on the surface in a third step, in which case a surface roughness of <0.5 μm, in particular <0.3 μm, should be set. What is achieved thereby is that the high resistance to oxidation and solid erosion can be maintained throughout the operating temperature of above 500° C. for a steam turbine blade consisting of ferritic/martensitic 9-12% Cr steel.

BRIEF DESCRIPTION OF THE DRAWINGS

An exemplary embodiment of the invention is illustrated in the drawing in which.

DETAILED DESCRIPTION OF EXEMPLARY EMBODIMENTS

Methods according to the present invention are explained in more detail below with reference to an exemplary embodiment and to FIGS. 1 to 2.

A ferritic 9% Cr steel (E911) with the following chemical composition (values in % by weight)

0.11 C
0.35 Mn
0.2 Si
9.1 Cr
1.01 Mn
1.00 W
0.23 V
0.07 N
0.07 Nb
the remainder iron and unavoidable impurities was treated according to the invention.

In a first step, in this case, the abovementioned steel was shot-peened with steel particles (carbon steel with a C content of 0.1%), the particles having a grain size of 200-450 μm. The process parameters were:

Pressure: 6 bar
Time: 4-5 min.
Angle (nozzle to the surface): 80-85°

The steel thus treated was subsequently, in a second step, shot-peened with glass particles (grain size: 300-400 μm). The process parameters in this second step were:

Pressure: 2-2.5 bar
Time: 4 min.
Angle (nozzle to surface): 80-85°

In both cases, there was advantageously no need for any subsequent heat treatment of the material, and therefore the method according to the invention can be used cost-effectively and simply.

Figure 1:
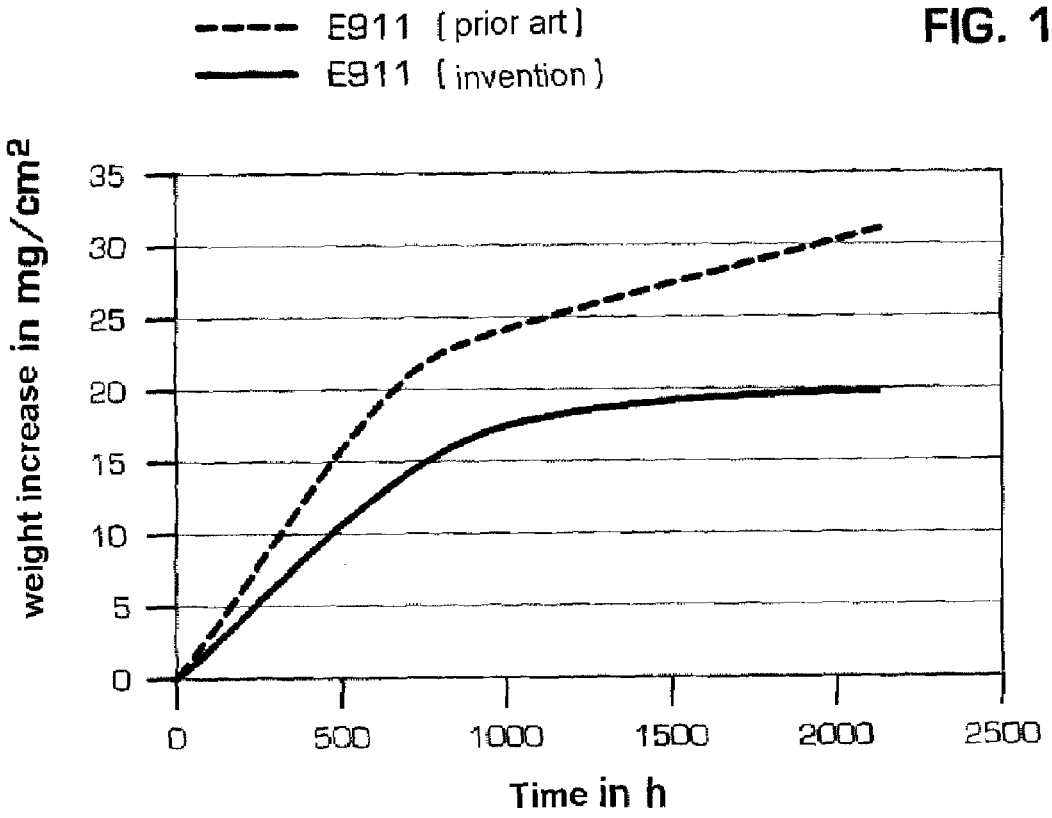
FIG. 1 shows the oxidation behavior of a ferritic 9% Cr steel treated according to the invention, with 650° C./steam, as compared with the oxidation behavior of an untreated ferritic 9% Cr steel.

FIG. 1 illustrates the oxidation behavior of the Cr steel treated according to the invention, as described above, with 650° C. steam, as compared with the oxidation behavior of an untreated ferritic 9% Cr steel.

The steel treated according to the invention is distinguished by an appreciably improved oxidation behavior. Particularly in the case of lengthy precipitation times, it is shown that the weight increase in the material treated according to the invention is substantially lower than in the untreated reference steel. After a precipitation time of approximately 2000 hours, for example, the weight increase in the untreated reference steel amounts to approximately 31 mg/cm$^2$, whereas, in the steel of identical composition treated according to the invention, it amounts to only 20 mg/cm$^2$. This last-mentioned value has become established even after approximately 1500 h and remains approximately constant. This cannot be said of the untreated reference steel since here, on the one hand, the absolute values are substantially higher and, on the other hand, even after a precipitation time of more than 2000 h in steam, it seems that there is still no constant value of the weight increase established, but, instead, it continues to rise with an increase in the precipitation time.

The method has the surprising effect that a mechanism other than the strain hardening process, ineffective in the case of ferritic/martensitic steels, caused by shot peening, clearly plays a part on the surface of the material. One possibility is that the glass particles are embedded into the surface or else microalloying of the surface takes place, thus giving rise to a protective action against oxidation.

Another positive effect of this method is associated with the efficiency of steam turbines. In order to ensure a high aerodynamic efficiency of the steam turbine, the blades are manufactured from the outset with a very fine surface (final roughness 0.3 μm). This low roughness level has to be maintained for the long operating time of the blades. However, during operation, the surface of the material may be roughened by the impingement and impact of hard (oxide) particles which have come loose from the component surface upstream of the blade, or else the oxidation of the blade surface in the high-temperature steam surroundings themselves causes oxides to flake off from the surface and an extreme roughening of the surface is thereby brought about. The above-described method should therefore advantageously be supplemented by a subsequent step for smoothing the surface, which, for example, may be tumbling after the peening with glass particles.

Figure 2:
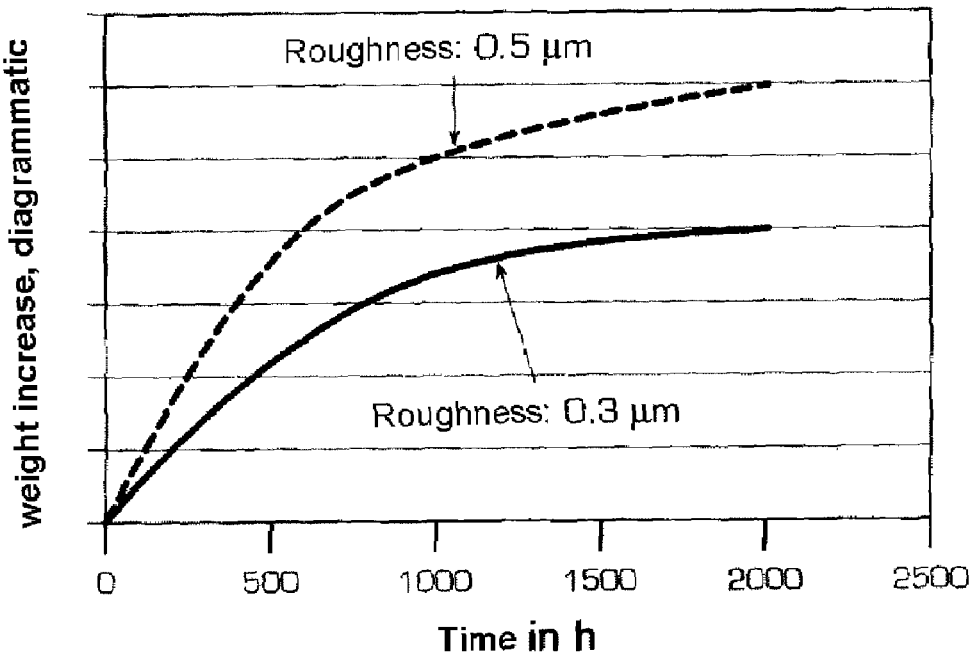
FIG. 2 shows the oxidation behavior of a ferritic 9% Cr steel treated according to the invention, with 650° C./steam, as a function of the surface roughness (diagrammatically).

FIG. 2 illustrates diagrammatically the oxidation behavior of a ferritic 9% Cr steel treated according to the invention, with 650° C. steam, as a function of the surface roughness.

It became apparent that, after the second step of the treatment method, the oxidation behavior of the steel can be further improved advantageously by a subsequent smoothing of the surface by tumbling to a roughness of less than 0.5 μm, preferably less than 0.3 μm, as a third optional method step.

Methods embodying principles of the present invention are therefore particularly suitable for components, for example blades, consisting of ferritic/martensitic 9-12% Cr steels which are exposed in gas and steam turbines to temperatures of above 550° C., preferably 600 to 650° C.

Of course, the invention is not restricted to the exemplary embodiment described. Both the material and the treatment parameters may be varied, thus, for example, the method according to the invention is also highly suitable for improving the oxidation resistance of the steel X20 (X20CrMoV12) or P91 (X10CrMoVNb91).

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A method for the surface treatment of ferritic/martensitic 9-12% Cr steels for achieving an improved oxidation behavior and increased resistance to solid particle erosion at application temperatures of above 500° C. in steam, the method comprising:

providing a portion of a turbine component, said portion comprising said steel surface;

shot peening the surface of the steel with steel particles; and subsequently shot peening the surface of the steel with glass particles.

2. The method as claimed in claim 1, further comprising:

smoothing the surface of the steel to a roughness less than 0.5 μm after said shot peening with glass particles.

3. The method according to claim 2, wherein smoothing comprises smoothing to a roughness less than 0.3 μm.

4. The method according to claim 1, further comprising:

wherein said providing comprises providing a portion of a turbine blade, said portion of a turbine blade comprising said steel surface.

* * * * *